United States Patent [19]

Marsh, Jr.

[11] 4,192,492

[45] Mar. 11, 1980

[54] DEVICE FOR FABRICATION OF TAPHOLES IN METALLURGICAL VESSELS

[75] Inventor: Harry A. Marsh, Jr., Pittsburgh, Pa.

[73] Assignee: Dresser Industries, Inc., Dallas, Tex.

[21] Appl. No.: 23,417

[22] Filed: Mar. 23, 1979

[51] Int. Cl.[2] ..... F27D 1/16

[52] U.S. Cl. ..... 266/281; 264/30; 266/287

[58] Field of Search ..... 266/236, 45, 280, 281, 266/283, 286, 287, 271, 243; 249/184, 185; 264/30

[56] References Cited

U.S. PATENT DOCUMENTS

| | | | |
|---|---|---|---|
| 3,295,845 | 1/1967 | Finn | 266/236 |
| 3,329,420 | 7/1967 | Finn | 266/236 |
| 3,396,961 | 8/1968 | Farrington | 264/30 |
| 3,458,607 | 7/1969 | Sullivan et al. | 266/271 |
| 3,801,058 | 4/1974 | Boto | 264/30 |
| 4,026,443 | 5/1977 | Meier | 266/271 |

*Primary Examiner*—L. Dewayne Rutledge
*Assistant Examiner*—Peter K. Skiff
*Attorney, Agent, or Firm*—J. N. Hazelwood; R. T. Majesko

[57] ABSTRACT

A device for installing a taphole is comprised of a vertical wall with laterally extending base wings which conform specifically to the configuration and contours of refractory blocks and a neck with laterally extending wings which conform specifically to the interior and exterior dimensions of refractory sleeves which are attached to the blocks and form a part of the taphole.

6 Claims, 3 Drawing Figures

DEVICE FOR FABRICATION OF TAPHOLES IN METALLURGICAL VESSELS

It has been standard practice in the steel industry to form basic oxygen furnace tapholes from dead burned magnesite refractories having a high MgO content, since magnesite is one of the best basic refractories known for contact with molten metal in basic steel making furnaces and for resisting the high temperatures and chemical attack which occurs in the operation of such furnaces.

Heretofore, basic oxygen furnace tapholes have been formed in a variety of ways. One such mode of installation was by ramming successive layers of magnesite grain about a steel pipe passing through the taphole opening in the furnace shell and opening into the furnace chamber until the taphole area was completely filled with the refractory. However, owing to the structure and location of the tapholes it was found difficult to ram all of the interstices or crevices in the taphole area and to obtain high densities thereby.

The same difficulties were encountered when completely vibration-casting the taphole area. There will be noted subsequently from the drawings that the taphole area, if located in the cone section of the furnace as in the basic oxygen furnace, is not an ideal place to endeavour a vibration cast taphole. Another object to the above method is that vibration casting mixes typically contain between 7 and 8% of water and the water must be removed during burn-in. It is important that the refractory employed for the taphole and the technique used to install it be compatible with the burn-in schedule of the refractory working lining of the basic oxygen furnace since it comprises the bulk of the furnace.

Another method of taphole installation that has been used is the precast refractory cylinder or preconstructed refractory brick cylinder with a centrally located longitudinal hole. These cylinders are of considerable diameter and length which has required motorized auxiliary equipment to install because of its weight. This method is considered by some as being less than totally safe. This method also is quite time consuming and difficult to precisely set in the predetermined location.

Accordingly, there has been a long existing need in the art for reducing the time required to install a basic oxygen furnace taphole; for eliminating the lack of uniformity inherent in rammed and vibration cast tapholes, and for significantly reducing the maintenance and repair costs and furnace down-time involved for delays in taphole area repairs in the operation of basic oxygen furnaces.

U.S. Pat. Nos. 3,295,845 and 3,329,420 assigned to the present assignee, disclose and claim prefabricated taphole assemblies for use in the basic oxygen vessels. These prefabricated tapholes have proved to cause an improvement in these vessels in that it is not uncommon to obtain between 100 and 140 heats before the need to repipe. One problem, however, is that the taphole assembly is normally composed of four shapes, i.e., a lower left and right to support a top left and right, although more shapes have been used. Depending on the vessel, each of these shapes, by design, can weigh approximately 200 pounds.

Accordingly, it can be appreciated that the precise setting of these shapes could require considerable time and effort. The many variables, including the interrelated height of the block to the hot face position of the sleeve at the steel housing outer flange, which is invariably distorted from the normal abuse of making steel, contribute to the time required for final taphole assembly setting. It is not uncommon to see the 200 pounds-shapes lifted by the brick masons several times before the final decision is made that it is properly positioned. Past methods involving jigs of the various designs have been used to position refractory taphole assemblies but because of the distortion of some steel shells, have been limited in their application.

Therefore, it is among the objects of this invention to provide a device for isntallating a taphole which conforms to the silhouette of the refractory taphole assembly and is rugged, collapsible and relatively light in weight.

In accordance with the present invention, there is provided a device for installing a taphole, which is composed of refractory blocks and sleeves in a metallurgical vessel. The metallurgical vessel consists of an outer metal shell, a refractory lining in contact with the interior of the shell and a taphole opening passing through the metal shell. The device has a vertical wall which conforms to the silhouette of the taphole blocks. A pair of lower wing members extend laterally from each side of the wall to the extent of the width of the taphole blocks. A vertical neck member extends forwardly of the vertical wall and terminates in a laterally extending wing conforming substantially to the internal and external dimensions of the taphole sleeves.

Figure 1:
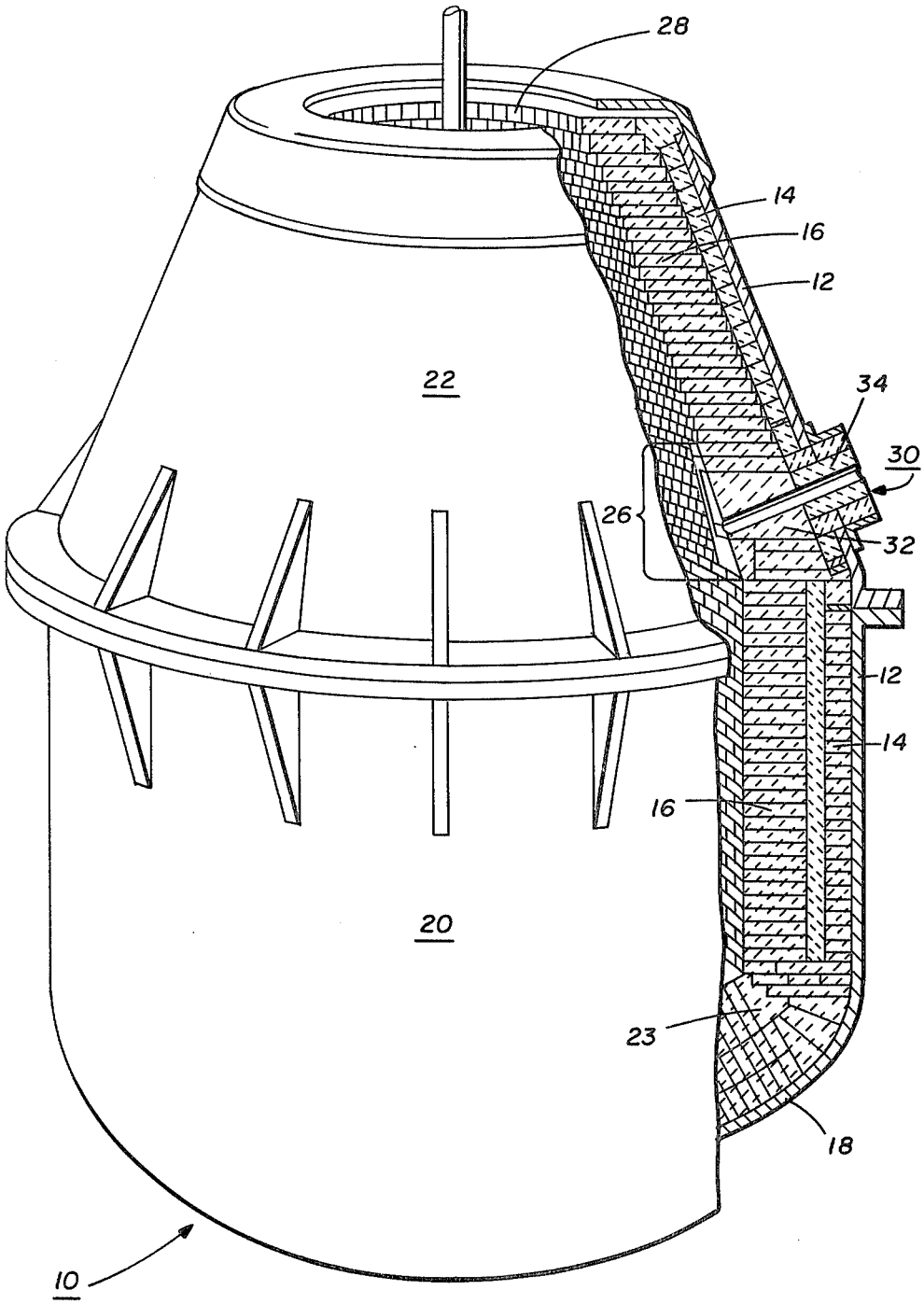
FIG. 1 is a perspective view, partly broken away, of a basic oxygen furnance, particularly showing the taphole side of the furnace.

Referring to FIG. 1, there is shown a basic oxygen furnace 10 consisting of an outer metal shell 12, a shell protective brick lining 14 in contact with the inside surface of the shell and a brick working lining 16. The vessel is constructed of three major zones, the bottom zone 18, the barrel zone 20 and the cone section zone 22. The bottom zone is dish shaped and of upwardly opening concave configuration. The brick 23 in the bottom zone terminate at the barrel zone 20 with their face surfaces inclined from the bottom upwardly to the cone section zone. The working lining brick 16 in both the barrel zone and the cone section zones are disposed so that their face surfaces are in the horizontal plane. The cone section zone having a taphole area 26 extends upwardly and terminates in the form of a mouth 28 at the top of the vessel. The cone section zones is of downwardly opening truncated crosssectional configuration.

Disposed in the taphole area of the vessel is a taphole assembly 30 which preferably conforms to the construction in the patents set forth previously. The taphole is composed of refractory blocks 32 and a refractory sleeve or sleeves 34.

Figure 2:
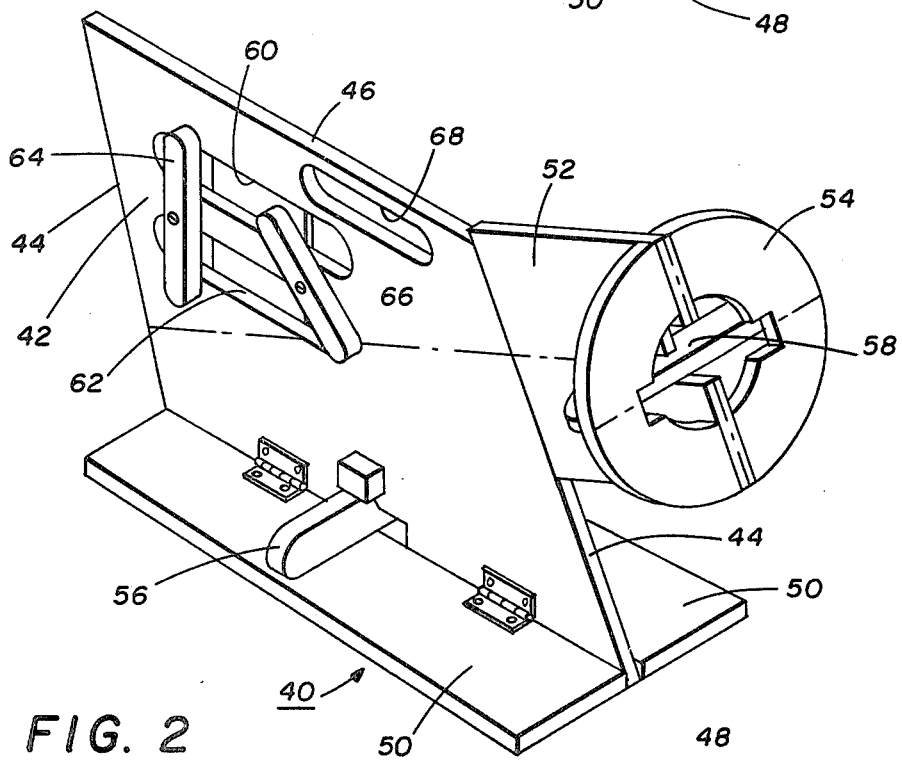
FIG. 2 is a perspective view of a device according to the invention in extended and usable form.

Referring to FIG. 2, there is shown the device 40 which conforms to the three necessary silhouettes to give the exact intergral relationship of a three dimensional refractory taphole assembly with sleeve or sleeves. The desired alignment within the furnance of the refractory assembly is expeditiously located by the use of the device and is not influenced by the furnances steel shell distortion due to warpage.

The device 40 comprises a vertical wall 42 which conforms to the silhouette of the taphole blocks. In this case, the vertical wall has end surfaces 44 which are unidirectly inclined with respect to the upper and lower surfaces 46 and 48. At the base of the vertical wall, a pair of wing members 50 extend laterally from each side of the wall. A vertical neck member 52 extends forwardly of the vertical wall and is inclined upwardly to conform to the opening in the vessel. The neck member terminates in a laterally extending wing 54 which conforms substantially to the internal dimensions of the taphole sleeves and in this case have a radial configuration.

The wing members 50 and 54 may be held in a firm position by braces 56 and 58 which pass through the body of the vertical wall 42 and neck 52 respectively and bear against the wings 50 and 54 respectively.

Figure 3:
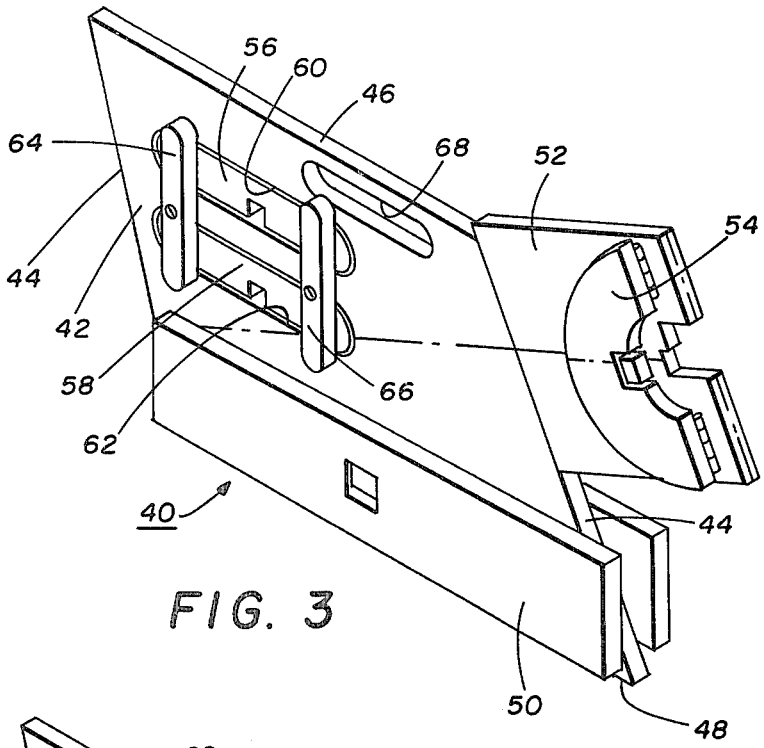
FIG. 3 is a perspective view of a device according to the invention in collapsed form for ease of transporting and storage.

As shown in FIG. 3, all of the wing members 50 and 54 can be folded for transporting and storage contiguous with the vertical wall 42 and laterally extending neck 52. The braces 52 and 58 may be stored in slots 60 and 62 when not in use. Brackets 64 and 66 secure the braces in the slots. A handle 68 on top of the device provides for easy transport.

The device is simple to employ in the vessel. It is set on the lining course in the vessel that is judged to be the bed course of the taphole assembly. Simultaneously, the position of the assemblies lower shapes with regard to the centerline of the taphole in the steel housing is set, which would be the position of the final sleeve. If either removing a working lining course or adding a course appears to be in order, this can easily be done and the taphole assembly position can be checked by moving the relatively lightweight device. After the device has been set to compensate for the prevailing conditions and located on the proper bed course to satisfy the intended design, the block base of the device can be scribed on the bed course of the lining. This is where the lower shape of the taphole assembly is laid. The rest of the total assembly including the sleeves would automatically be positioned as desired.

It is intended that the foregoing description and drawings be construed as illustrative and not in limitation of the invention.

The embodiments of the invention in which an exclusive property or priviledge is claimed are defined as follows:

1. A device for installing a taphole, composed of refractory blocks and sleeves, in a metallurgical vessel having an outer metal shell, a refractory lining in contact with the interior of the shell and a taphole opening passing through the metal shell comprising a vertical wall conforming to the silhouette of the taphole blocks, a pair of lower wing members extending laterally from each side of the wall to the extent of the width of the taphole blocks, and a vertical neck member extending forwardly of the vertical wall, said neck member terminating in a laterally extending wing conforming substantially to the internal and external dimensions of the taphole sleeves.

2. The device of claim 1, in which the forwardly extending neck member is inclined upwardly.

3. The device of claim 1, in which the laterally extending wing for the sleeves has a radial configuration.

4. The device of claim 1, in which the vertical wall has end surfaces which are unidirectionally inclined with respect to the upper and lower surfaces.

5. The device of claim 1, in which the laterally extended wing members are firmly locked into the extended position by braces.

6. The device of claim 1, in which means are provided for folding the laterally extending wing members contiguous with the vertical wall and laterally extending neck respectively.

* * * * *